US006845288B2

(12) United States Patent
Pierel et al.

(10) Patent No.: US 6,845,288 B2
(45) Date of Patent: Jan. 18, 2005

(54) METHOD AND DEVICE FOR MEASURING A POSITION OF A PASSING SHEET

(75) Inventors: Frank Pierel, Kiel (DE); Helmut Buck, Schriesheim (DE); Carsten Huschle, Bretten (DE)

(73) Assignees: Heidelberger Druckmaschinen AG, Heidelberg (DE); Nexpress Solutions LLC, Rochester, NY (US)

( * ) Notice: Subject to any disclaimer, the term of this patent is extended or adjusted under 35 U.S.C. 154(b) by 231 days.

(21) Appl. No.: 10/122,614

(22) Filed: Apr. 15, 2002

(65) Prior Publication Data

US 2002/0177918 A1 Nov. 28, 2002

(30) Foreign Application Priority Data

Apr. 14, 2001 (DE) ..... 101 18 556

(51) Int. Cl.[7] ..... G06F 19/00

(52) U.S. Cl. ..... 700/194; 382/112; 382/254; 382/276; 382/286; 382/287; 382/289; 382/293; 382/295; 382/296; 101/2

(58) Field of Search ..... 700/194; 101/2; 382/112, 162, 254, 276, 286, 287, 289, 293, 295, 296; 355/18, 19, 32, 78, 79; 348/88, 95

(56) References Cited

U.S. PATENT DOCUMENTS 4,518,862 A 5/1985 Dorn 6,671,386 B1 * 12/2003 Shimizu et al. ..... 382/296

FOREIGN PATENT DOCUMENTS

DE 32 32 490 C2 3/1983
DE 37 10 161 A1 10/1988

* cited by examiner

*Primary Examiner*—Leo Picard
*Assistant Examiner*—Charles Kasenge
(74) *Attorney, Agent, or Firm*—Laurence A. Greenberg; Werner H. Stemer; Ralph E. Locher

(57) ABSTRACT

The position of sheets in a printing press is measured. A problem in transporting sheets through the printing press is how to guarantee the correct orientation and lay of the sheets, which must be guaranteed particularly in the printing operation. There is provided a device for precisely determining and correcting the positions of sheets in printing presses. Margin regions of a sheet are respectively imaged, projection data are transmitted to a computing unit, and the position of the sheet is calculated with the aid of the projection data by way of an image recognition algorithm. Furthermore, the computed positions of the sheet are compared to positions which are stored in the computing unit, and from the comparison, position deviations are computed, which are transmitted to the printing press and corrected by way of a sheet registration device.

14 Claims, 4 Drawing Sheets

METHOD AND DEVICE FOR MEASURING A POSITION OF A PASSING SHEET

BACKGROUND OF THE INVENTION

Field of the Invention

The invention lies in the sheet processing and printing fields and relates, more specifically, to a method for measuring positions of passing sheets with an image generation system for generating at least a sectional projection of a sheet and to a device for measuring positions of sheets for a printing press.

In the printing industry, a wide variety of presses are used, which have different paper paths, i.e. the course over which the sheet, as the printing material, travels in the printing press. In the transport of the sheet, its correct orientation and lay, which must be guaranteed particularly in the print operation, are problematic. The term "orientation" pertains to the angular alignment or relative skew of the sheet. The term "lay" pertains to its vertical and horizontal lay. The term position encompasses the concepts of orientation and lay. Thus, all points in two-dimensional space can be described with the position. An incorrect position of the sheet leads to errors in the printed image, particularly in color printing, in which several color separations are superimposed on one another. The positionally correct overprinting of the color separations, i.e., the proper registration and in-register alignment, determines the sharpness impression and is one of the most important features of the print quality. Besides this, an incorrect position of the sheet in the print operation leads to shifts of the overall image being printed, which is usually composed of several color separations. Various solutions have been proposed for guaranteeing the correct orientation and lay, i.e. the correct position, of the sheet in the printing press. A common technique of the prior art is to utilize measuring marks of various sizes and designs, which are known as register marks (and in German as Registermarken or Passmarken), which are placed on the sheet or on a conveyor belt. With the aid of these register marks, the position of the sheet can be determined various ways, for instance by means of a sensor which determines the margins of the register marks and from these the position of the sheet. The obvious disadvantage of this solution is the expensive application of register marks onto the sheets. In another solution, the printing press utilizes CCD (Charge-Coupled Device) lines to detect positions, which detect the front and side edges of the sheet. This proposed solution is disadvantageous because the edges of the sheet are usually not shaped exactly correctly and therefore distort the measurements.

Another device which is known from the prior art consists in driving the sheet that is to be aligned against one or two sheet stops and aligning it with the aid of these stop edges or lays. But in this technique, deformations of the sheet can arise, on one hand, or, on the other hand, the sheet can rebound from the alignment edge, preventing a positionally exact transfer.

SUMMARY OF THE INVENTION

It is accordingly an object of the invention to provide a method and a device for determining a position of a passing sheet, which overcomes the above-mentioned disadvantages of the heretofore-known devices and methods of this general type and which measures the position of sheets and other printing material exactly.

With the foregoing and other objects in view there is provided, in accordance with the invention, a method of measuring a position of a passing sheet, which comprises:

transporting a sheet past an image generation system;

imaging margin regions of the sheet and generating projection data;

transmitting the projection data to a computing unit; and calculating the position of the sheet from the projection data with an image recognition algorithm.

In accordance with a preferred mode of the invention that is specifically adapted to a printing press, the method comprises:

comparing calculated positions of the sheets to stored positions in the computing unit;

computing position deviations from a result of the comparing step;

transmitting the position deviations to the printing press; and correcting the position deviations with a sheet registration device in the printing press.

With the above and other objects in view there is also provided, in accordance with the invention, a device for measuring a position of a passing sheet in a sheet-processing device, such as a printing press, a printer, or a copier, the device comprising:

a projection device for imaging the sheet in the sheet-processing device; and a computing unit connected to the projection device for evaluating imaging data received from the projection device, for evaluating projections of the projection device.

In other words, the objects of the invention are achieved in that margin regions of the sheet are respectively imaged, projection data are transmitted to a computing unit, and the position of the sheet is computed with the aid of the projection data by means of an image recognition algorithm.

In order to create an automatic correction method, the detected positions of the sheet are compared to stored positions in the computing unit, position deviations from the comparison step are calculated, the position deviations are transmitted to the printing press, and these are corrected by a sheet registration device. It is advantageous to utilize at least two digital cameras which are furnished with CCD technology, these being contained in the projection device. The digital projection data can therefore be utilized by the computing unit directly.

The positions of the imaged sheets can already be calculated from the projection data with the aid of the sheet edges. This means that the positions are already computable by determining the x-y coordinates of two points from the projection data in a coordinate system in the computing unit.

To increase the measuring sensitivity, the individual sheet margins are imaged and evaluated multiple times, and then average values are formed from the acquired projection data.

The image recognition algorithm in the computing unit advantageously calculates sections of the margin regions of a projection at the sheet margin; i.e., at the transition of the sheet to the carrier of the sheet, and from the sections it calculates the position of the sheet. This way, the position of the sheet can be determined with little computing expenditure.

An advantageous development further consists in imaging the margin regions of a sheet on a CMOS sensor chip. The basic principle of this consists in a two-dimensional position-sensitive sensor which is built in a pixel matrix, whereby each pixel consists of a photosensitive surface. With the aid of software-supported evaluation electronics with which the rows and columns of the pixels can be compared, the location of the paper's edges can be easily detected. Besides the signal evaluation, with which a voltage which depends on the intensity of the light impinging upon the respective pixel is evaluated, an address logic is additionally employed for determining the local position at which the edge of the paper is located. The progression of the paper's edge during the movement can be identified according to evaluation software, given possible edge speeds up to 0.75 m/s.

According to the pixel matrix, a two-dimensional position detection is also possible with the aid of this sensor, and therefore an alignment of two edges of a rectangular sheet, whereby the alignment benefits from the provision of two sensors positioned at the respective corners of a sheet. The parallelism of the sheet edges, for instance relative to a downstream gripper bar, can be determined more precisely according to this configuration. The downstream gripper bar takes the sheet from the feeder and feeds it to a printing press. When two sensors are positioned at the respective corners of a sheet, the exact size of each sheet can be checked. The result of this measurement can be utilized for statistical purposes, or steps such as sheet rejection can be taken.

The inventive device allows aligning without alignment edges, which avoids the above-mentioned problems and has the additional advantage that the sheet is forwarded to the press without stopping, i.e. continuously. This increases the sheet feeding speed. But it would also be imaginable to allow the sheet to stop during the aligning process.

Other features which are considered as characteristic for the invention are set forth in the appended claims.

Although the invention is illustrated and described herein as embodied in a method and device for measuring positions of passive sheets, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
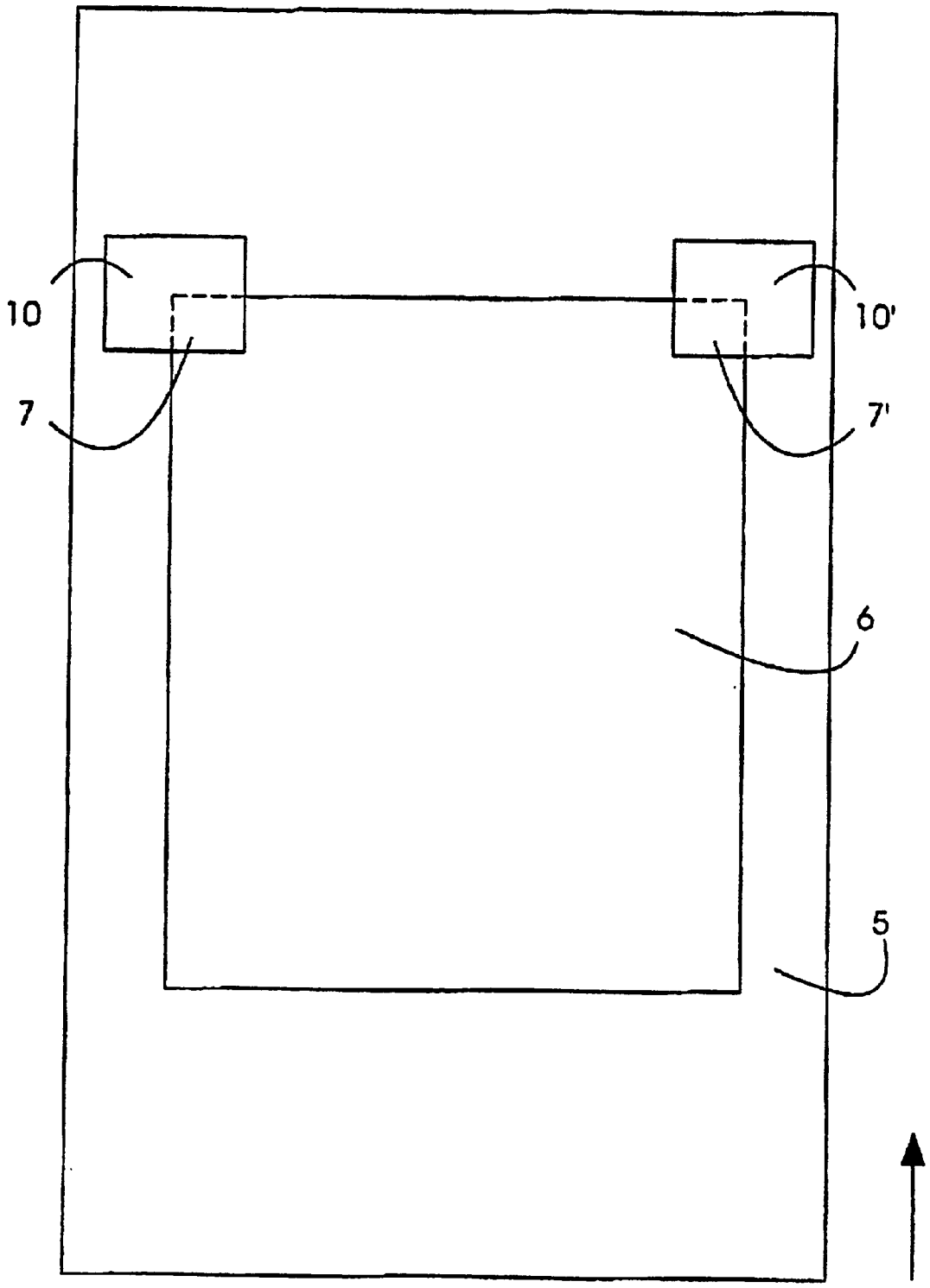
FIG. 1 a schematic plan view of a sheet on a conveyor belt, and two cameras that form part of a projection system.

Referring now to the figures of the drawing in detail and first, particularly, to FIG. 1 thereof, there is shown a plan view representing a section of a continuous conveyor belt 5 which is commonly used in printing presses. The conveyor belt 5 is driven and moves in the direction indicated by the arrow. A typical speed for the belt 5 is 300 mm per second. A single sheet 6 of a printing material to be printed is disposed on the conveyor belt 5. The sheet 6 is held on the conveyor belt 5 substantially by electrostatic forces which act on the basis of electrostatic charges that are applied to the conveyor belt 5, and it moves through the printing press with the belt, accordingly. Above the conveyor belt 5 and the sheet 6, two digital cameras 10, 10' are arranged in the margin region 7 of the sheet 6 as part of a projection system. The microchips of the cameras 10,10' preferably contain CCD technology. The shutter speed of the cameras 10,10' can be 1/100,000 s, for instance. A high shutter speed of cameras 10,10' is necessary in order to achieve a high measuring sensitivity. The slower the shutter speed of the cameras 10,10' is, the further the sheet 6 moves on the conveyor belt 5 during the recording or projecting, thereby impairing the measurement result, given that the time allocation of the recording or projecting of the sheet 6 to the position of the sheet 6 constitutes a basic principle of the measuring technique. The recording lenses of the cameras 10,10' are directed vertically into the plane of view in the direction of the adjacent sheet on the conveyor belt 5. The margin regions 7 of the sheet 6 which are covered by the cameras 10,10' in this observation process are indicated in FIG. 1 by dotted lines. With the aid of a trigger signal of a control unit of the projection system, the cameras 10,10' are actuated the instant the margin regions 7 of the sheet 6 beneath the cameras 10,10' are located in their image recording region. The imaging of the margin regions 7 of the sheet 6 produces digital data, referred to here as projection data. As will be described below, these acquired projection data are processed. FIG. 1 represents the case in which the sheet 6 does not exhibit any position deviations; i.e., the sheet 6 is in the desired orientation and lay and has shifted neither horizontally nor vertically relative to the conveyor belt 5. The projections of the margin regions 7,7'—which correspond approximately to the contours, as represented in FIG. 1, of the cameras 10,10' B show mirror-symmetrical projections of the margin regions 7 and 7', whereby the side margins and front margin of the sheet 6 extend parallel to the side and top margins, respectively, of the recording regions of the cameras 10,10'.

Figure 2:
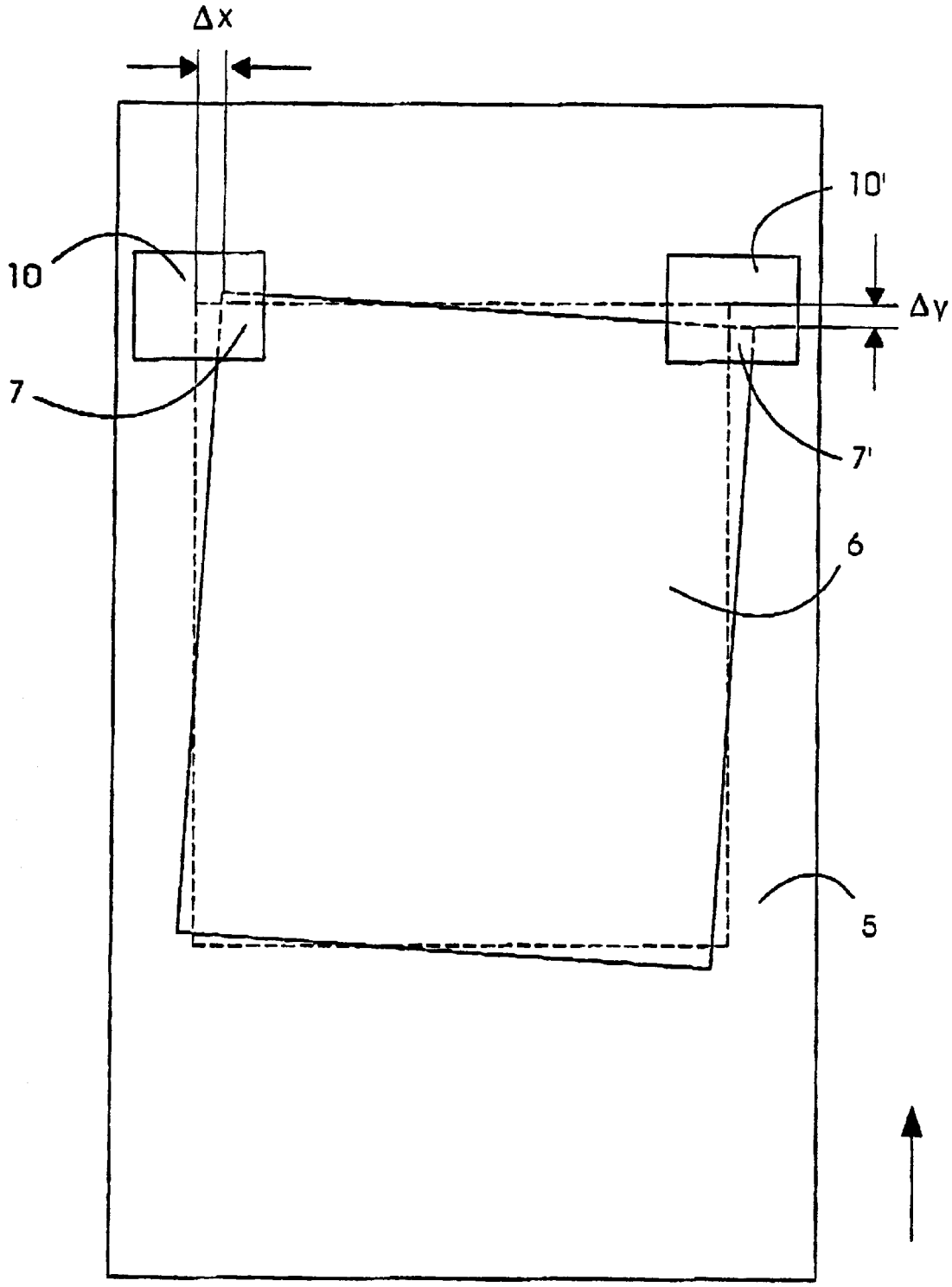
FIG. 2 a similar representation to FIG. 1, whereby the sheet exhibits position deviations.

FIG. 2 represents the case in which the sheet 6 exhibits undesirable deviations in the vertical and horizontal directions relative to the plane of view, referenced $\Delta y$ and $\Delta x$, respectively, owing to an angle displacement. With the aid of the values $\Delta y$ and $\Delta x$, the angle by which the sheet 6 has shifted relative to the correct position (indicated by the dotted rectangle) can be determined in the computing unit by simple geometric operations. The projection process is identical to the process described in FIG. 1. The projections are clearly different than the operation in FIG. 1, and consequently the acquired digital projection data are also different. The condition which is present in FIG. 2 with position deviations of the sheet 6 leads to errors in the subsequent printing process and must therefore be corrected.

Figure 3:
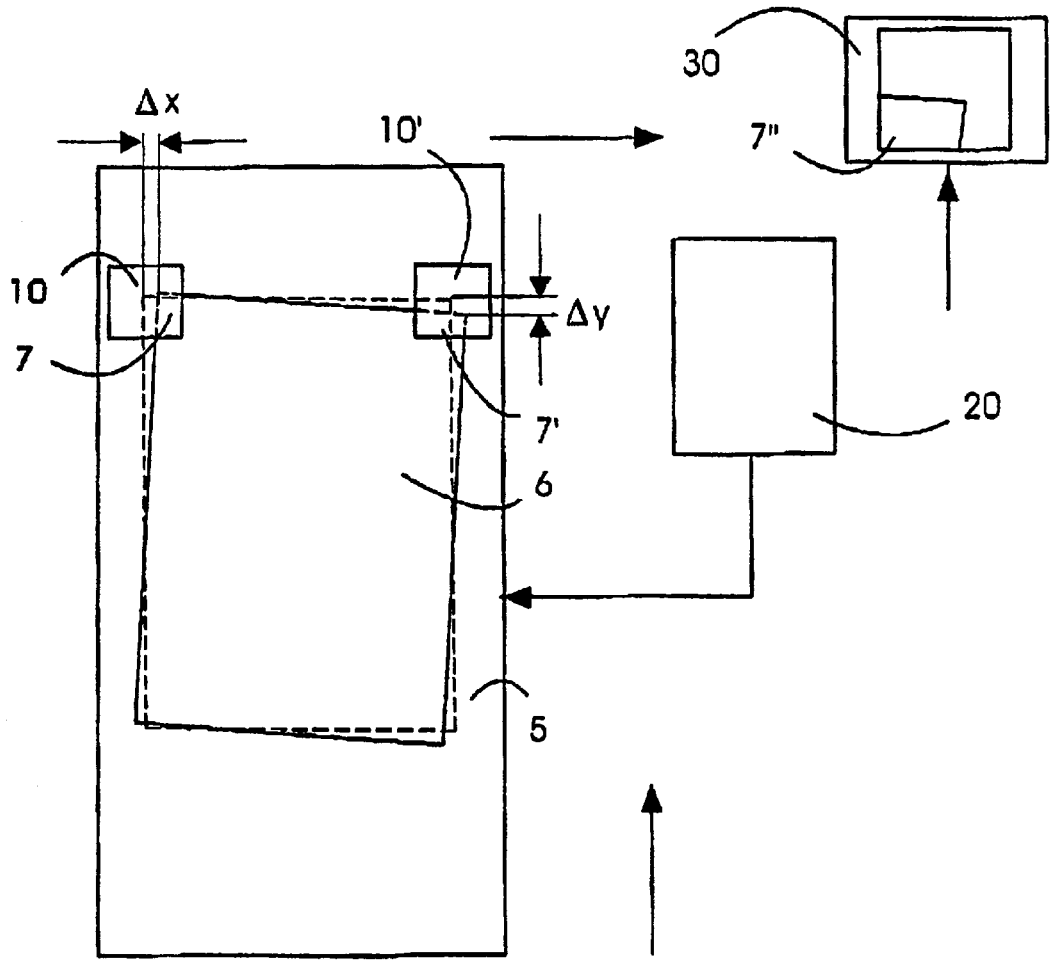
FIG. 3 a similar representation to FIG. 2, with a block diagram of a computing unit and screen.

The schematic representation according to FIG. 3, wherein the position deviations which were represented in FIG. 2 are visibly present, will now be described for purposes of explaining the method for measuring positions and correcting position deviations. As above, the sheet 6 is transported on the conveyor belt 5 in the direction of the arrow, and the margin regions 7,7' are imaged by the cameras 10, and 10' consequent to a trigger signal. The digital projection data are transmitted by the cameras 10, 10' to a computing unit 20 via a connection. Provided in the computing unit 20 is an image recognition algorithm, in which the projection data can be evaluated. In this process, the light/dark transition of the projection from the sheet 6 to the conveyor belt 5 is detected. In FIG. 3, primarily for purposes of illustration, a monitor 30 is connected to the computing unit 20, on which the projection data of the margin region 7' of the sheet 6 which have been transmitted by the camera 10' are exemplarily displayed as image 7". The monitor 30 is not important to the invention. With the image recognition algorithm, the sheet corners of the margin regions 7, 7' (i.e. the outermost point on the sheet 6 that can be detected with the given resolution) are defined as pixels in the computing unit 20. For each projected recording and each margin region 7 and 7', the image recognition algorithm computes a pixel; the two pixels of simultaneously imaged margin regions 7 and 7' unambiguously define the orientation and lay of the sheet 6. As opposed to the method of the prior art in which the sheet margins are detected with sensors, defining the corners of the sheet always provides the geometrically unambiguous position of the sheet 6. With the aid of the pixels which are computed by the image recognition algorithm relative to known stored nominal coordinates of the pixels, it can be determined by what angle position and what length in the horizontal and vertical directions the sheet 6 has shifted. These displacements are computable and correctable into the micrometer range. On this basis, perfect positioning on the conveyor belt 5 can be guaranteed with a subsequent correction step. The computing unit 10 sends the correction values, which it computes from nominal pixels and actual pixels, to a control device (not represented) of the printing press, which performs a correction, via controllers, of the impression cylinder or the web travel by means of positioning elements.

Specifically, in addition to the detection of pixels of the margin regions 7,7' of the sheets 6, utilizing an image recognition algorithm makes possible the additional variations of the step for determining the position of the sheet 6. The projection can capture the sheet 6 as a whole; this makes it possible to ascertain whether the shape of the sheet 6 is flawed, i.e., whether, for example, the margin regions 7,7' of the sheets 6 are damaged or creased. This situation is then taken into account by the image recognition algorithm in the calculation of the correction values. For example, if a portion of sheet in a margin region 7,7' is missing from the projection owing to creasing of the sheet 6, the image recognition algorithm interpolates the missing sheet portion and defines the correct pixel of the sheet corner of the margin region 7,7', i.e. one x-y coordinate per sheet corner. Furthermore, different sheets 6 of the same format have different dimensions; i.e., the lengths, edges and angles of the sheets 6 are not known to the micrometer. In the DIN 476 format, the DIN allows length tolerances of 2 mm. In customary techniques for measuring positions, these high tolerance values are frequently mistaken for position deviations. Given the capture of the whole sheet 6 by the projection system, or of the four margin regions 7,7' of a sheet 6, the computing unit 20 recognizes deviating dimensions of the sheet 6 with the aid of the projection data, but it does not mischaracterize these as position deviations and does not correct them with the aid of the sheet register unit. The technique and device for measuring positions are described for sheets 6 which are passing through; the measuring takes place with sheets 6 in motion. This disclosure also comprises the stopping of passing sheets 6 and the measuring of the position of the sheets 6 while stationary.

Figure 4:
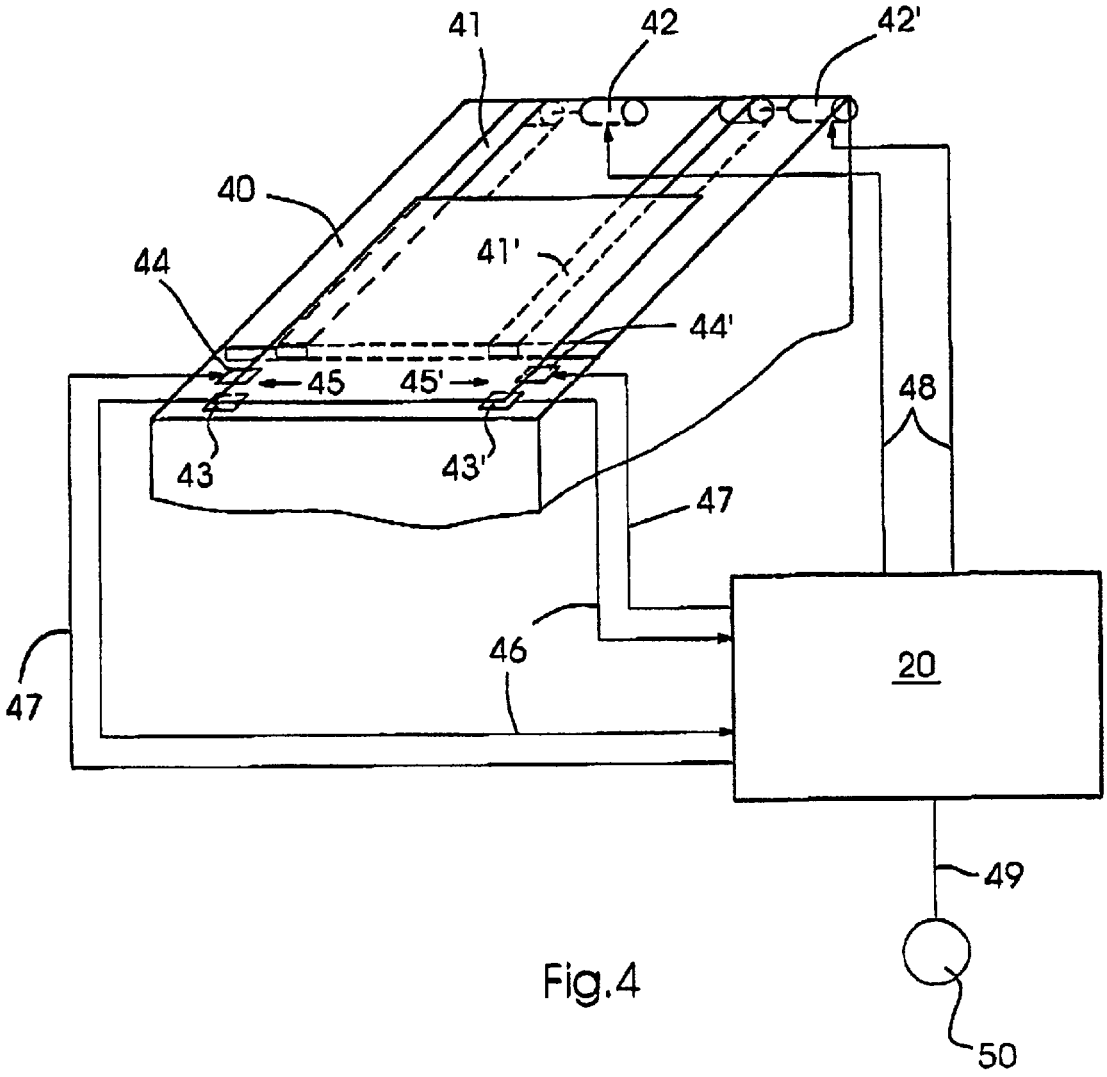
FIG. 4 a schematic plan view of a sheet on conveyor belts and two sensors as the projection system.

FIG. 4 represents a feedboard 40 on which two continuous conveyor belts 41,41' are arranged. In contrast to FIG. 1, a sheet 6 is located on two conveyor belts 41, 41'. The conveyor belts 41,41' can be fashioned as perforated conveyor belts 41, 41' through which a vacuum which is located underneath the conveyor belts 41,41' (but which is not represented in the Fig.) acts on the sheet 6, or the conveyor belts 41,41' can exert an electrostatic holding force on the sheet (as represented in FIG. 1). For the sake of simplicity, the application of the electrical charge to the conveyor belts 41,41' is also not represented. The conveyor belts 41,41' are driven by separately actuated drives 42,42', by which, given different drive speeds of drives 42,42', the lay of the sheet 6 can be displaced. Also located on the feedboard 40 are sensors 43,43', by which the lay of the sheet 6 can be detected, and pulling devices 44,44'. With the pull device 44,44' a lateral aligning of the sheet 6 according to the arrows 45,45' can be performed if the aligning of the sheet 6 by the conveyor belts 41,41' driven by the drives 42,42' still has not succeeded to the necessary extent. The pulling device 44,44' is so constructed that a driven roller is pressed against a non-driven roller, with the sheet 6 between the driven and non-driven rollers. It is assumed that either the pulling device 44 or the pulling device 44' is active. But a variant would also be imaginable in which the two pulling devices 44 and 44' both acted on the sheet 67 with different forces, whereby the sheet 6 would be pulled to the side on which the greater force acted, though the sheet would be simultaneously stretched.

The signals of the sensors 43,43' are supplied by means of signal lines 46 of a computing unit 20. The computing unit 20 computes the position of the paper edge with the aid of a comparison of the pixels, which are arranged in rows and columns, in the sensors 43,43'. In its most general sense, this algorithm can be considered an image recognition algorithm, though it is substantially simpler and can therefore be performed less expensively in terms of time and computing outlay. The computing unit then undertakes the actuation of the drives 42,42' and the actuation of the pulling device 44,44' in alternation. The actuation of the drives 42,42' and the pulling device 44,44' occurs via control lines 47,48. In order to guarantee a synchronization of the sheet transport to a downstream printing press (which is not represented), the computing unit 20 receives the current angle position of the printing press, which is determined by an angle resolver 50, over an additional signal line 49.

We claim:

1. A method of measuring a position of a passing sheet, which comprises:

transporting an unprinted sheet past an image generation system;

imaging margin regions of the sheet and generating projection data;

transmitting the projection data to a computing unit; and calculating the position of the sheet from the projection data with an image recognition algorithm.

2. The method according to claim 1, which comprises:

comparing calculated positions of the sheets to stored positions in the computing unit;

computing position deviations from a result of the comparing step;

transmitting the position deviations to the printing press; and correcting the position deviations with a sheet registration device in the printing press.

3. The method according to claim 1, which comprises determining the position of the imaged sheet with the aid of sheet corners defined from the projection data.

4. The method according to claim 1, which comprises taking multiple images of an individual margin region of the sheet being transported through the printing press; and forming average values from the projection data in the computing unit.

5. The method according to claim 4, which comprises statistically evaluating the average values.

6. The method according to claim 1, which comprises computing sections of the margin regions of a projection with the computing unit; and computing the position of the sheet with the aid of the sections of the projection data by the image recognition algorithm.

7. A device for measuring a position of a passing unprinted sheet in a sheet-processing device, the device comprising:

a projection device for imaging the unprinted sheet in the sheet-processing device; and a computing unit connected to said projection device for evaluating imaging data received from said projection device, for evaluating projections of said projection device.

8. The device according to claim 7, wherein the sheet-processing device is one of a printing press, a printer, and a copier.

9. The device according to claim 7, wherein said projection device comprises a two-dimensional position-sensitive sensor surface for detecting at least one corner of the sheet.

10. The device according to claim 9, which comprises at least one positioning element or allocated to said computing unit.

11. The device according to claim 10, wherein said at least one positioning element is a drive driving a conveyor belt.

12. The device according to claim 10, wherein said at least one positioning element is a pulling device for pulling the sheet.

13. The device according to claim 7, wherein said projection device contains at least two CCD cameras.

14. The device according to claim 7, wherein said computing unit is programmed with an image recognition algorithm.

* * * * *